US005780967A

United States Patent [19]

Suyama et al.

[11] Patent Number: 5,780,967

[45] Date of Patent: Jul. 14, 1998

[54] ELECTRON TUBE WITH A SEMICONDUCTOR ANODE OUTPUTTING A DISTORTION FREE ELECTRICAL SIGNAL

[75] Inventors: Motohiro Suyama; Kimitsugu Nakamura; Masuo Ito, all of Hamamatsu, Japan

[73] Assignee: Hamamatsu Photonics K.K., Shizuoka-ken, Japan

[21] Appl. No.: 705,678

[22] Filed: Aug. 30, 1996

[30] Foreign Application Priority Data

Aug. 31, 1995 [JP] Japan ..... 7-223612

[51] Int. Cl.[6] ..... H01J 40/16

[52] U.S. Cl. ..... 313/541; 313/2.1

[58] Field of Search ..... 313/542, 544, 313/541, 376, 103 R, 105 R, 384, 399, 528, 530, 532, 1, 2.1; 250/214 VT, 333, 370.09, 370.11

[56] References Cited

U.S. PATENT DOCUMENTS

| | | | |
|---|---|---|---|
| 3,688,122 | 8/1972 | Santilli et al. | 250/213 VC |
| 3,937,964 | 2/1976 | Muehllehner | 250/214 VT |
| 4,180,759 | 12/1979 | Harris et al. | 250/333 |
| 4,317,063 | 2/1982 | Pedder et al. | 250/333 |
| 4,323,925 | 4/1982 | Abell et al. | 313/376 |
| 4,625,153 | 11/1986 | Micic et al. | 315/370 |
| 4,626,694 | 12/1986 | Sano et al. | 250/214 VT |
| 5,120,949 | 6/1992 | Tomasetti | 250/207 |
| 5,146,296 | 9/1992 | Huth | 357/19 |

FOREIGN PATENT DOCUMENTS

| | | | |
|---|---|---|---|
| 2-15981 | 4/1990 | Japan | H01J 31/50 |
| 3-34242 | 2/1991 | Japan | H01J 31/50 |

OTHER PUBLICATIONS

Patent Abstracts of Japan, vol. 10, No. 325 (E-451) 61-133543 (Toshiba Corporation), *abstract.

*Primary Examiner*—George M. Dombroske
*Assistant Examiner*—Harshad Patel
*Attorney, Agent, or Firm*—Sughrue, Mion, Zinn, Macpeak & Seas, PLLC

[57] ABSTRACT

To eliminate a distortion of an output image detected by a semiconductor device serving as an anode in an electron tube, a faceplate is configured to a planar shape and a window provided on the semiconductor device has a pin-cushion outer profile in which points on the outer profile of the window that correspond to points on the outer profile of the faceplate are outwardly positioned farther than the corresponding points in the outer profile of the faceplate that are apart from the center of the faceplate. Further, the window is divided into a plurality of segments to define picture elements.

21 Claims, 3 Drawing Sheets

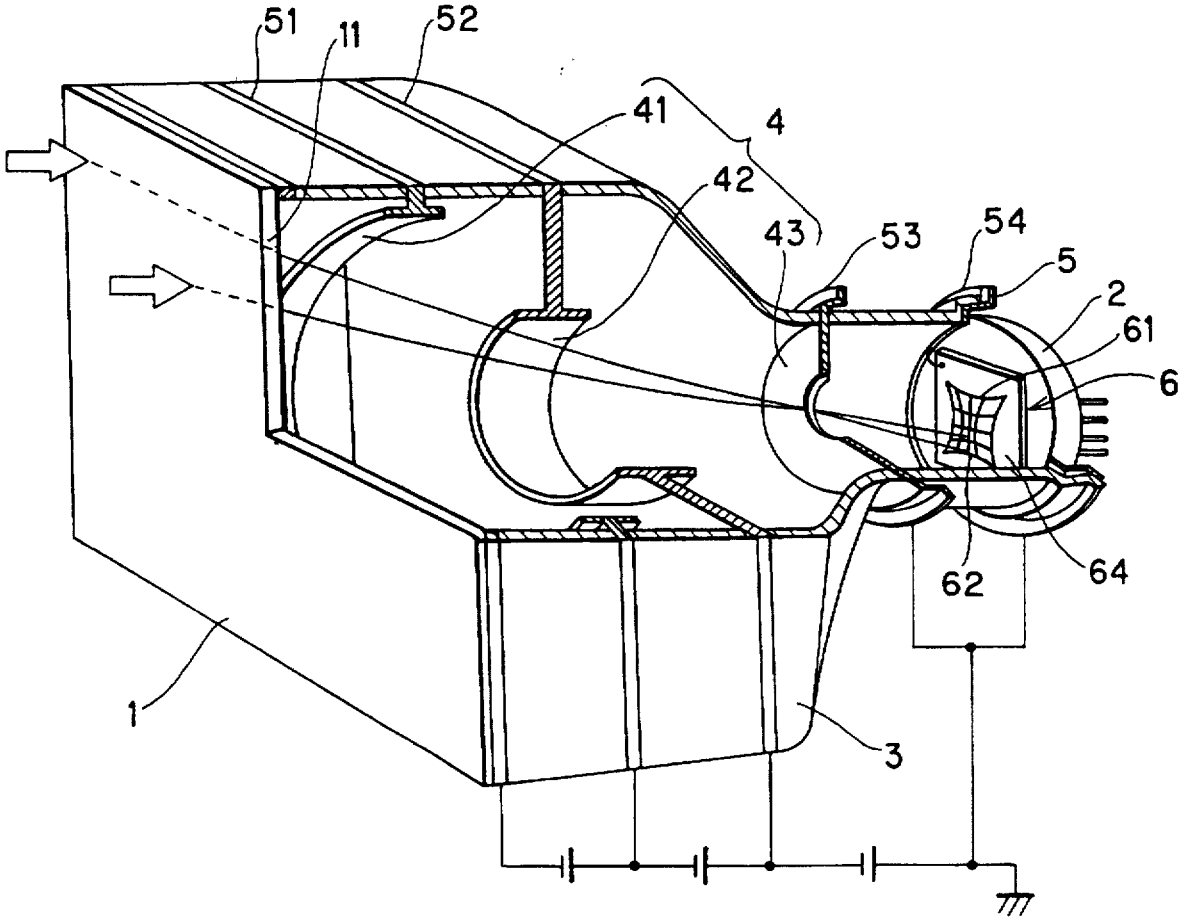
51
11
52
41
4
42
43
53
54
5
2
61
6
62
64
1
3

ELECTRON TUBE WITH A SEMICONDUCTOR ANODE OUTPUTTING A DISTORTION FREE ELECTRICAL SIGNAL

BACKGROUND OF THE INVENTION

1. Field of the Invention

The present invention relates to an electron tube which detects minute light incident thereon by multiplying photoelectrons produced from the incident light. More particularly, the invention relates to an electron tube capable of providing an output signal which is free from distortion.

2. Description of the Prior Art

An electron tube is a device for detecting minute, two-dimensional incident radiation by multiplying the same. Such an electron tube is, for example, used as a component for an image intensifier used for astronomic observations and observations of nocturnal animals.

The electron tube includes a tubular sidewall. A faceplate is hermetically sealed to one end of the sidewall and a stem is hermetically sealed to the opposite end of the side wall. The tubular sidewall, the faceplate, and the stem form an airtight chamber with the faceplate and the stem being disposed in confronting relation to each other with a predetermined distance therebetween. The surface of faceplate confronting the stem has formed thereon a photocathode. The surface of the stem confronting the faceplate is provided with a semiconductor device which receives photoelectrons and outputs an electric signal. An electron lens is disposed in a space between the photocathode and the stem. The electron lens is provided for controlling paths of electrons traveling between the photocathode and the semiconductor device.

In this electron tube, an input optical image incident on the outer surface of the faceplate is converted into photoelectrons in the photocathode. The resultant photoelectrons are released toward and focused on the semiconductor device by virtue of the electron lens. The semiconductor device provides an output image in the form of an electrical signal.

A problem with the above-described electron tube is that the output image provided by the semiconductor device is somewhat distorted when compared with the input image. As described above, the photoelectrons released from the photocathode travel along a path controlled by the electric field of the electron lens. The greater the distance from a central axis of the tubular sidewall, the more abruptly the potential in the electric field changes. Therefore, the photoelectrons travelling farthest from the central axis are unduly curved by the electric field, so that the bombardment positions of the photoelectrons against the semiconductor device are shifted from target positions and hence the output image becomes distorted.

Japanese Laid-Open Patent Publication No. HEI-3-34242 proposes a method of reducing the output image distortion. However, it is impossible to completely eliminate the distortion unless an ideal condition is established. One solution to eliminate the distortion is to use only the electric field of the electron lens at portions near the central axis of the tubular sidewall. However, if this is done, the effective diameter of the electron tube becomes small. Therefore, this method is available only when the size of the electron tube is not a matter of concern. On the other hand, this method is not practical when the outer size of the electron tube is an important factor.

Another method for reducing the distortion is to configure the photocathode in a spherical shape. Specifically, the photocathode is configured to a spherical shape so that a center of the curvature of the spherical shape is located in a cross-over point of the electron beams. With such a spherical photocathode, distances from various points on the photocathode to the cross-over point become equal, hence the output distortion caused by the electron lens can be reduced. The output distortion can further be reduced if the surface of the semiconductor device is configured to the same spherical shape. However, if the photocathode has a spherical shape, there is a problem that a planar scintillator (which is a component that emits fluorescence corresponding to incident radiation such as gamma beams) and the faceplate cannot be in facial contact with each other. In addition, it is almost impossible to configure the surface of the semiconductor surface to a spherical shape.

Japanese Examined Patent Publication (Kokoku) No. HEI-2-15981 discloses an imaging tube for solving the aforementioned problems. The imaging tube has a faceplate with a rectangular shape. The distortion of the image appearing in the output surface resulting from the use of the rectangular shape faceplate is solved by developing an electric field of rotational symmetry. However, to realize the proposal by the above publication, it is necessary that a multiplicity of terminals be provided to penetrate through the side wall of the tube to apply voltages thereto. Even if the proposal can be realized, it is extremely difficult to eliminate the distortion of the output image completely.

SUMMARY OF THE INVENTION

In view of the foregoing, the present invention has been made to solve the above-described problems, and accordingly an object of the present invention is to provide an electron tube capable of outputting a distortion free signal representing the input optical image.

To achieve the above and other objects, there is provided an electron tube that is constructed from a tubular side wall having first and second ends, a planar faceplate hermetically sealed to the first end of the tubular sidewall, a stem hermetically sealed to the second end of the tubular sidewall wherein the tubular sidewall, the planar faceplate and the stem form an airtight chamber. A photocathode is formed on the inner surface of the planar faceplate, which produces electrons in response to incident radiation thereon. An electrode assembly is provided within the airtight chamber for developing an electric field when the electrode assembly is applied with voltages. The electric field acts as an electron lens when the electrons pass therethrough. The electrons are subject to locus distortion by the electron lens. A semiconductor device is attached to the inner surface of the stem and has a window confronting the photocathode for bombardment of the electrons that have passed through the electron lens. The window has such an outer profile that cancels the locus distortion of the electrons received thereat. The semiconductor device multiplies the electrons and produces an output signal representative of the radiation incident on the photocathode.

In operation, the incident radiation on the planar faceplate is converted to photoelectrons in the photocathode formed on the inner surface of the faceplate and the photoelectrons are emitted toward the semiconductor device. At this time, the photoelectrons are focused by the electron lens and a distorted image is incident on the semiconductor device. However, the window of the semiconductor device is configured to a shape that cancels the distortion. Specifically, points on the outer profile of the window that correspond to points on the outer profile of the faceplate are outwardly positioned farther than the corresponding points on the outer profile of the faceplate that are apart from the center of the faceplate. Stated differently, the further a portion of the faceplate is from the center of the faceplate, the further a corresponding portion of the window will extend from the center of the window. For example, when the faceplate is a rectangular shape, the outer profile of the window is a pincushion configuration having four apex portions corresponding to the four corners of the rectangular shape and four inwardly curved lines, each connecting two adjacent apex portions, corresponding to the sides of the rectangular shape.

In accordance with the present invention, the window is divided into a plurality of segments, each defining a picture element. A plurality of electrodes are provided to respective ones of the plurality of segments individually, and also a plurality of pins are provided which penetrate through the stem and connected to respective ones of the plurality of electrodes individually for deriving the output signal therefrom. As such, an output image that is free from distortion can be obtained. Further, the planar faceplate is suitable for use in combination with a planar member such as scintillator.

The outer profile of the planar faceplate is, for example, a rectangular shape, so that when a plurality of electron tubes are arranged in row and column, there is no dead space between adjacent faceplates and thus the incident radiation can be faithfully translated into an electrical signal.

BRIEF DESCRIPTION OF THE DRAWINGS

The particular features and advantages of the invention as well as other objects will become more apparent from the following description taken in connection with the accompanying drawings, in which:

FIG. 3 is a perspective view showing an example of an application of an electron tube.

DETAILED DESCRIPTION OF THE PREFERRED EMBODIMENTS

Figure 1:
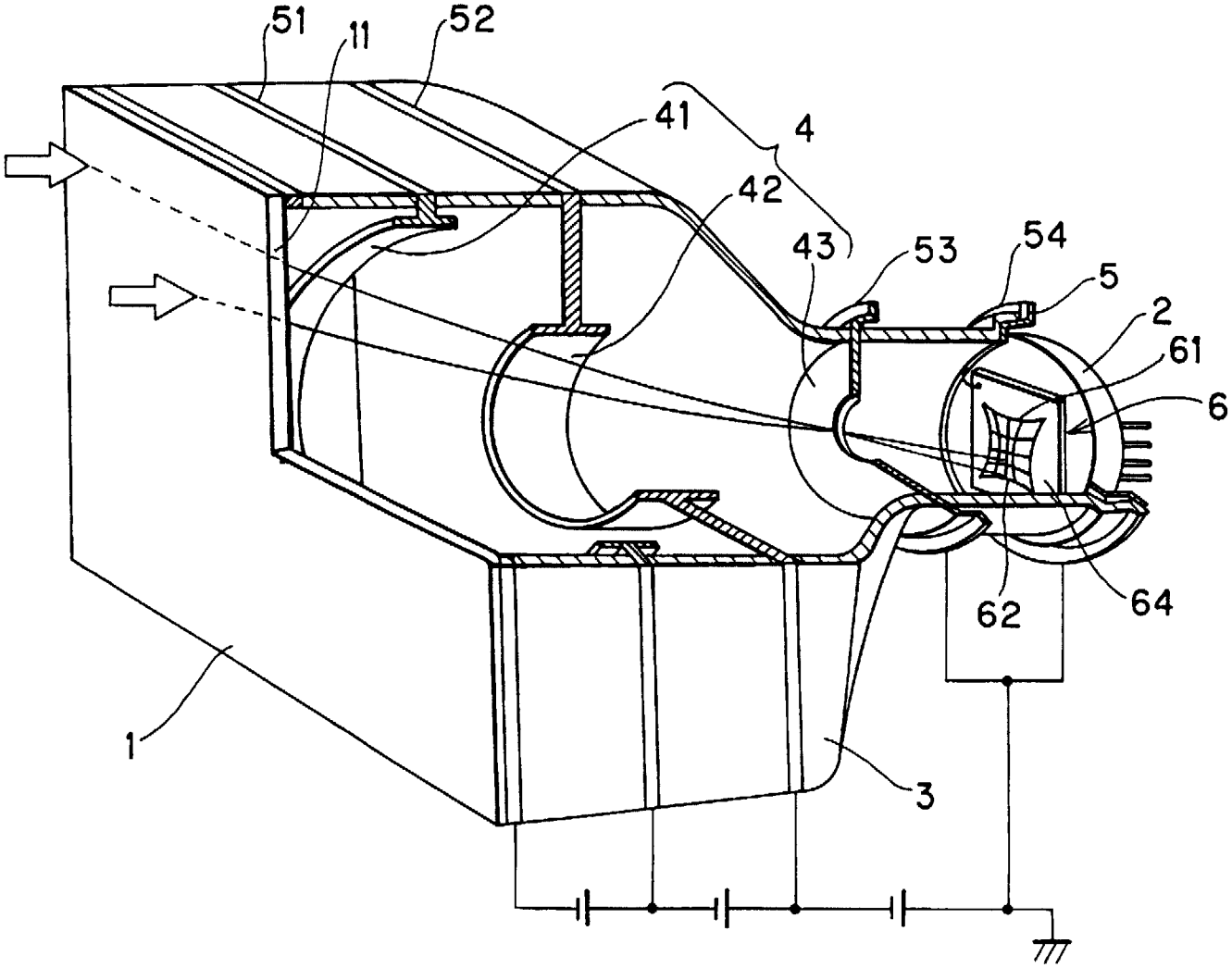
FIG. 1 is a schematic diagram showing an electron tube according to one embodiment of the present invention with a part of the tube shown in cross section and a remaining part showing an exterior view of the tube.

An electron tube according to one embodiment of the present invention will be described with reference to the accompanying drawings. In the drawings, the same reference numerals denote the same components.

Figure 2:
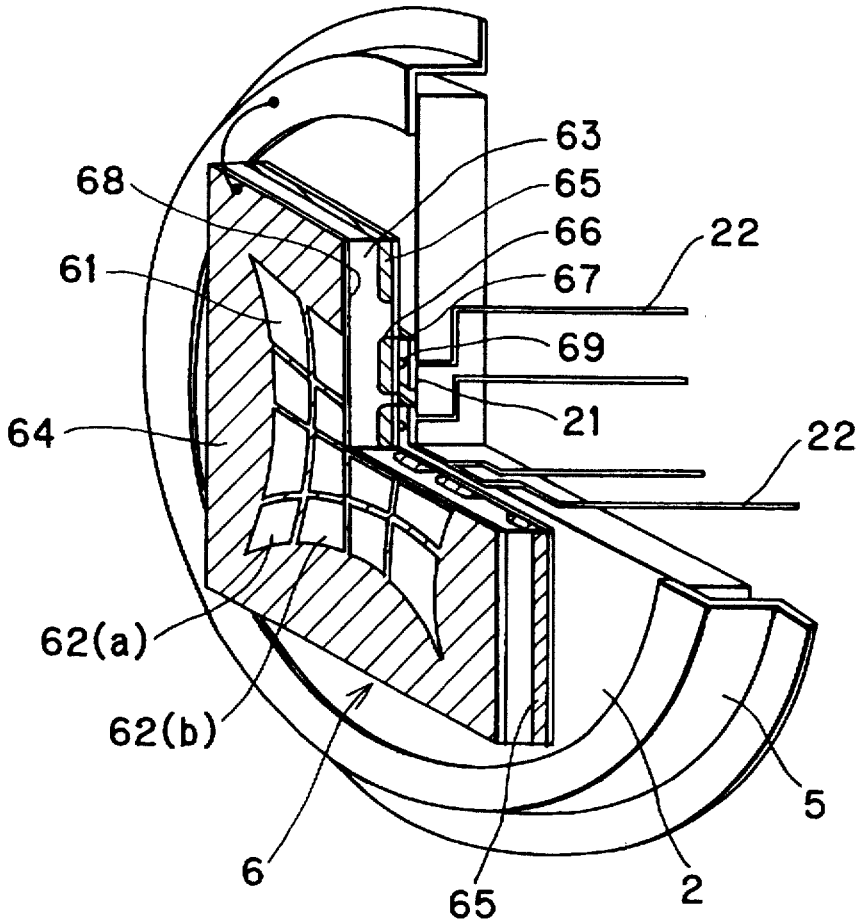
FIG. 2 is an enlarged perspective view, with a partial cut away portion, showing a semiconductor device serving as an anode in the electron tube shown in FIG. 1.

FIG. 1 schematically shows the entirety of the structure of the electron tube. FIG. 2 shows a semiconductor device.

As shown in FIG. 1, an electron tube 10 is basically constructed with a faceplate 1, a stem 2, and a tubular sidewall 3. The faceplate 1 is hermetically sealed to one end of the tubular sidewall 3 and the stem 2 is hermetically sealed to another end of the tubular sidewall 3. The tubular sidewall 3, the faceplate 1 and the stem 2 form an airtight chamber. The inside of the airtight chamber is maintained in a vacuum condition. A photocathode 11 is formed on the inner surface of the faceplate 1 and produces photoelectrons in response to incident radiation thereon. A semiconductor device 6 serving as an anode is attached to the inner surface of the stem 2. The semiconductor device 6 has a window that confronts the photocathode 11. An electrode assembly including a first electrode 41, a second electrode 42 and a third electrode 43 are disposed within the airtight chamber for developing an electric field when the respective electrodes are supplied with appropriate voltages. The electric field acts as an electron lens when the photoelectrons pass therethrough.

The tubular sidewall 3 is generally in a bottle-like shape having a bottle neck portion and a body portion. The stem 2 is a seal end of the bottle neck portion and the faceplate 1 is a seal end of the body portion.

The faceplate 1 is provided for receiving an input optical image thereat and is a plate-like planar member formed to a rectangular shape and made from, for example, glass. The photocathode 11 formed on the inner surface of the faceplate 1 is made from a transparent photoelectric converting material. Examples of such materials are alkali metals including Cs, Na, K, and Rb, a compound semiconductor including GaAs, or other material such as AgO. The photocathode 11 emits photoelectrons toward the stem 2 when light is incident on the outer side of the faceplate 1.

In the inner space of the tubular sidewall 3 and between the faceplate 1 and the stem 2 is formed an electron lens 4. The electron lens 4 is provided for controlling the travelling paths of the photoelectrons released from the photocathode 11. The electron lens 4 is formed by the first, second and third electrodes 41 to 43 which are cylindrical shapes and spaced apart by a predetermined distance between adjacent electrodes in the longitudinal direction of tubular sidewall 3 and also coaxial with respect to the central axis of the sidewall 3. An electric field is developed inside the tubular sidewall 3 by the application of voltages to the respective electrodes 41 to 43 through leads 51 to 53 exposed on the tubular sidewall 3. The travelling paths of the photoelectrons are controlled by the electric field thus developed. The photoelectrons are converged by the electron lens and a smaller size electron image is formed on the semiconductor device 6.

The faceplate 1 used in this embodiment has a rectangular shape with an outer dimension of 100 mm×100 mm. It is desirable that the electron lens 4 reduce the size of the image to one tenth or so of the original size. It should be noted that the components that form the electron lens 4 are not limited to those described above but other components having different shapes and arrangements can be employed, provided that the travelling paths of the photoelectrons can be controlled with the electron lens 4 formed by such components.

The stem 2 is formed from ceramics of a multi-layer structure and has a planar shape. A ring-shaped kovar flange 5 having a crank cross section is brazed to the periphery of the stem 2. The stem 2 is secured to the open portion of the tubular side wall 3 through the kovar flange 5. The semiconductor device 6 is attached to the inner surface of the stem 2 (i.e., the surface confronting the faceplate 1). The semiconductor device 6 receives the photoelectrons emitted from the photocathode 11, multiplies the photoelectrons, and outputs an electrical signal accordingly. The semiconductor device 6 has a surface formed with a window 61 for bombardment of the electrons that have passed through the electron lens.

The window 61 has a pincushion outer profile. Points on the pincushion outer profile that correspond to points on the outer profile of the faceplate 1 are outwardly positioned farther than the corresponding points in the outer profile of the faceplate 1 that are apart from the center of the faceplate 1. Stated differently, the pincushion outer profile of the window 61 is defined by four inwardly curved lines, each connecting two adjacent apex portions of four apex portions distributed like a rectangular shape. More specifically, the faceplate 1 is a rectangular shape having four apex portions, and the window 61 has corresponding four apex portions. The outer profile of the window 61 is defined by the inwardly curved side lines that are obtained when the four apex portions are moved inwardly along diagonal lines connecting opposing two apex portions whereby the lines connecting two adjacent apex portions are inwardly curved. By the shape of the window 61, distortion of the photoelectrons when incident on the window 61 is canceled.

The window 61 is divided into a plurality of segments 62(*a*), 62(*b*), each defining a picture element. Therefore, the positions of light incident on the faceplate 1 can be accurately identified by the segmented window 61. The outer profile of the window 61 and the shape of the segment on the window 61 are determined depending on the degree of distortion exerted on the electrons when passing through the electron lens. Concrete determination of those shapes are based on the travelling paths of the photoelectrons emitted from various parts of the photocathode 11. The paths of the photoelectrons can be obtained by computing the electric field formed by the respective electrodes 41 to 43 forming the electron lens 4. Although the window 61 shown in FIG. 2 is divided into sixteen (16=4×4) segments thus providing sixteen picture elements 62, the number of segments or picture elements may be determined appropriately depending on the situation. Also, segments may take another shape different from those shown in FIG. 2.

A multi-channel photodiode is, for example, employed for the semiconductor device 6. The concrete structure of the multi-channel photodiode is shown in FIG. 2 in which an n-type silicon substrate 63 having a high resistivity of 10 kilo ohms is used as a basic material. The surface (which confronts the faceplate 1) of the substrate 63 is coated to provide an electrode 64 in portions other than the window 61. An N+ channel stop layer 65 is formed to surround the edge portions in the inner surface of the substrate 63. A p-type layer 66 having the same shape as the window 61 and divided into a plurality of segments corresponding to the picture elements 62*a*, 62*b*, . . . 62*p* is formed in the portion surrounded by the n+ channel stop layer 65. Electrodes 67 are connected to the respective p-type layer segments 66. An n+ layer 68 is formed below the electrode 64 and all over the surface of the substrate 63. The electrode 64 is electrically connected by wire bonding to the kovar flange 5. The n+ channel stop layer 65 can be formed by a diffusion of phosphorus, the p-type layer 63 by a diffusion of boron, and the n+ layer 68 by a diffusion of phosphorus.

As shown in FIG. 2, a plurality of bonding pads 21 are formed in the inner surface of the stem 2 so as to confront the respective electrodes 67 of the semiconductor device 6, and are bump bonded and electrically connected to the respective p-type layers 66 through a metal bump 69 formed on the surface of the electrodes 67. A plurality of pins 22 extend from the outer surface of the stem 2 corresponding to the respective bonding pads 21. Each pin 22 is connected to the corresponding bonding pad 21 and outputs an electrical signal corresponding to the light incident on the electron tube 10.

Next, operation of the electron tube 10 will be described. In FIG. 1, the kovar flange 5 and the electrode 64 attached to the surface of the semiconductor device 6 are held at 0 volts prior to light detection. However, −8 kV is applied to the photocathode 11, −7.5 kV to the electrode of the electron lens 4, −5 kV to the electrode 42, and 0 V is applied to the electrode 43. A reverse bias voltage of 200 V is applied to the semiconductor device 6. In this condition, when light is incident on the outer surface of the faceplate 1, the light is converted to photoelectrons by the photocathode 11, and the photoelectrons are released therefrom toward the stem 2.

A predetermined electric field is developed in the interior of the electron tube 10 by virtue of the cylindrical electrodes 41 to 43 to create the electron lens 4. The thus developed electric field accelerates the photoelectrons. The photoelectrons then fall incident on the window 61 of the semiconductor device 6 provided in the stem 2. The photoelectrons released from the positions away from the center of the photocathode 11 are largely curved by the electric field of the electron lens 4. This tendency increases if the positions from which the photoelectrons are released are separated further from the center of the photocathode 11. The photoelectrons fall incident on the window 61 after travelling a greatly curved path. Two-dimensional observation of the behavior of photoelectrons indicates that, compared to the optical image input to the faceplate 1, the image of the photoelectrons incident on the window 61 is distorted so that portions of the image at the outer side and which are farther from the center of the window 61 appear to be greatly stretched outwardly. When both the faceplate 1 and the photocathode 11 are planar shapes, the distance from the edge portion of the photocathode 11 to the cross-over point (in the vicinity of the electrode 43 in the case of FIG. 1) is greatly different from the distance from the center portion of the photocathode 11 to the cross-over point. Therefore, the distortion of the input image of photoelectrons becomes more notable.

In the present invention, the loci of the photoelectrons are computed in advance. Based on the computation, the window 61 is shaped to have a pincushion outer profile obtained by moving the apex portions of a rectangular shape inwardly of the diagonal lines. Also, the window 61 is divided into a plurality of (sixteen) picture elements 62. Therefore, the photoelectrons emitted from the faceplate 1 are incident on the segments defining the picture elements 62 corresponding positionally to the faceplate 1. The photoelectrons incident on the segments 62 lose energy in the semiconductor device 6 and are thereby multiplied while producing about 1,500 pairs of electrons and holes. The resultant holes are derived as an electrical signal from the pins 22 via the electrode 67 and the bonding pad 21.

According to the thus constructed electron tube 10, through multiplication of the optical input image a distortion free output image can be output as an electrical signal using a rectangular, planar faceplate.

Next, a description will be made with respect to application of the above-described electron tube 10 to a gamma camera. As shown in FIG. 3, a plurality of electron tubes 10 are arranged to form the gamma camera 20. The faceplates 1 of the electron tubes 10 are attached to the rear side surface of a scintillator 7 with a planar diffusion plate 8 made of glass sandwiched therebetween. The scintillator 7 converts incident gamma beams to visible light. In FIG. 3, reference numeral 9 designates an initial stage circuit for reading the output signal of the electron tubes 10. The gamma camera 20 is constructed with electron tubes 10 having faceplates 1 of rectangular outer profiles. Therefore, the faceplates 1 can be tightly arranged in rows and columns with no gaps between adjacent faceplates 1, so that the gamma beams incident on the scintillator 7 can be received without fail by any of the electron tubes. Further, due to the planar shape of the faceplate 1 of the electron tube 10, the respective faceplates 1 can be in facial contact with the scintillator 7 through the diffusion plate 8 and can be arranged in parallel with the scintillator 7. Thus, the gamma beams incident on the scintillator 7 can be accurately received at the electron tube 10. As described, the gamma camera 20 can output a distortion free electrical signal which accurately reflects the condition at which gamma beams fall incident on the scintillator 7.

The outer profile of the faceplate 1 of the above-described electron tube 10 is not limited to a rectangular shape but any other shapes such as hexagonal or triangular shapes are also applicable insofar as gap-less arrangement is possible. The electron tubes 10 employing the faceplates of such shapes can multiply the optical input image and output distortion free electrical signal representing an output image.

According to the present invention, the following advantages can be obtained.

The faceplate for receiving light is a planar shape, the outer profile of the semiconductor device window which receives the photoelectrons produced as a result of photoelectrical conversion has such a shape that portions are extended from the center further with increasing distance from the center outward, and the window is divided into a plurality of segments. Having such features, the distribution of the photoelectrons applied to the semiconductor device is distorted with respect to the optical input image incident on the faceplate but are corrected by the semiconductor device. Consequently, a distortion free electrical signal can be output.

Further, because the outer profile of the faceplate is rectangular and the window has a shape in which apex portions of a rectangular shape are extended along the diagonal lines, the light incident on the faceplate can be output as an electrical signal that is free from distortion. In addition, because there is no substantial dead space when a plurality of electron tubes are arranged in row and column, the fidelity output electrical signal can be obtained.

While only one exemplary embodiment of this invention has been described in detail, those skilled in the art will recognize that there are many possible modifications and variations which may be made in this exemplary embodiment while yet retaining many of the novel features and advantages of the invention. Accordingly, all such modifications and variations are intended to be included within the scope of the appended claims.

What is claimed is:

1. An electron tube comprising:

a tubular sidewall having first and second ends in a longitudinal direction and a center axis in the longitudinal direction;

a faceplate hermetically sealed to said first end of said tubular sidewall and having a surface and a center on the surface, said faceplate being a planar shape having an outer profile;

a stem hermetically sealed to said second end of said tubular sidewall and having a surface, said tubular sidewall, said faceplate and said stem forming an airtight chamber with the surface of said faceplate and the surface of said stem both being directed inwardly of said airtight chamber;

a photocathode formed on said surface of said faceplate, which produces electrons in response to incident radiation thereon;

an electrode assembly provided within the airtight chamber, for developing an electric field when said electrode assembly is applied with voltages, the electric field acting as an electron lens when the electrons pass therethrough, wherein the electrons are subject to locus distortion by the electron lens; and a semiconductor device attached to the surface of said stem and having a window confronting said photocathode for bombardment of the electrons that have passed through the electron lens, the window having such an outer profile that cancels the locus distortion of the electrons received thereat, said semiconductor device multiplying the electrons and producing an output signal representative of the radiation incident on said photocathode.

2. An electron tube according to claim 1, wherein said window is divided into a plurality of segments, each defining a picture element.

3. An electron tube according to claim 2, wherein said semiconductor device comprises a multichannel photo diode.

4. An electron tube according to claim 2, further comprising a plurality of electrodes provided to respective ones of said plurality of segments individually, and a plurality of pins penetrating through said stem and connected to respective ones of said plurality of electrodes individually for deriving the output signal therefrom.

5. An electron tube according to claim 1, wherein said electrode assembly comprises a plurality of electrodes each having a cylindrical shape and disposed in spaced apart relation in the longitudinal direction of the tubular sidewall and also in coaxial relation with respect to the center axis, and wherein points on the outer profile of the window that correspond to points on the outer profile of said faceplate are outwardly positioned farther than the corresponding points in the outer profile of said faceplate that are apart from the center of said faceplate.

6. An electron tube according to claim 5, wherein said faceplate is a rectangular shape and the outer profile of the window has four apex portions and four inwardly curved lines each connecting two adjacent apex portions.

7. An electron tube according to claim 5, wherein said tubular sidewall is a bottle-like shape having a bottle neck portion including the second end and a body portion including the first end, said body portion being a rectangular shape in cross-section having four apex portions and diagonal lines connecting opposing two apex portions, and wherein said window has corresponding four apex portions that are extended inwardly along the diagonal lines.

8. An electron tube according to claim 7, wherein said electron lens acts to converge the electrons.

9. An electron tube according to claim 1, wherein said faceplate has such a shape that when a plurality of faceplates of the same shape are arranged in row and column, no gap is formed between adjacent faceplates.

10. An electron tube according to claim 9, wherein said faceplate is a rectangular shape.

11. An electron tube according to claim 9, wherein said faceplate is a hexagonal shape.

12. An electron tube according to claim 9, wherein said faceplate is a triangular shape.

13. A light detecting device comprising:

a planar scintillation plate having a first planar surface receiving incident radiation thereat and a second surface;

a planar diffusion plate having a first surface in facial contact with the second surface of said planar scintillation plate and a second surface;

a plurality of electron tubes arranged in row and column, each of said plurality of electron tubes comprising:

a tubular sidewall having first and second ends in a longitudinal direction and a center axis in the longitudinal direction, said tubular side wall being oriented in a direction so that the longitudinal direction is perpendicular to the second surface of said planar diffusion plate;

a faceplate hermetically sealed to said first end of said tubular sidewall and having a first surface in facial contact with the second surface of said diffusion plate, a second surface, and a center on the second surface, said faceplate being a planar shape having an outer profile;

a stem hermetically sealed to said second end of said tubular sidewall and having a surface, said tubular sidewall, said faceplate and said stem forming an airtight chamber with the second surface of said faceplate and the surface of said stem both being directed inwardly of said airtight chamber;

a photocathode formed on said second surface of said faceplate, which produces electrons in response to incident radiation thereon;

an electrode assembly provided within the airtight chamber, for developing an electric field when said electrode assembly is applied with voltages, the electric field acting as an electron lens when the electrons pass therethrough, wherein the electrons are subject to locus distortion by the electron lens; and a semiconductor device attached to the surface of said stem and having a window confronting said photocathode for bombardment of the electrons that have passed through the electron lens, the window having such an outer profile that cancels the locus distortion of the electrons received thereat, said semiconductor device multiplying the electrons and producing an output signal representative of the radiation incident on said photocathode, wherein said faceplate has such a shape that when said plurality of electron tubes are arranged in row and column, no gap is formed between adjacent faceplates.

14. A light detecting device according to claim 13, wherein said window is divided into a plurality of segments, each defining a picture element.

15. A light detecting device according to claim 14, wherein said semiconductor device comprises a multichannel photo diode.

16. A light detecting device according to claim 14, further comprising a plurality of electrodes provided to respective ones of said plurality of segments individually, and a plurality of pins penetrating through said stem and connected to respective ones of said plurality of electrodes individually for deriving the output signal therefrom.

17. A light detecting device according to claim 13, wherein points on the outer profile of the window that correspond to points on the outer profile of said faceplate are outwardly positioned farther than the corresponding points in the outer profile of said faceplate that are apart from the center of said faceplate.

18. A light detecting device according to claim 17, wherein the outer profile of the window has four apex portions and four inwardly curved lines each connecting two adjacent apex portions.

19. A light detecting device according to claim 17, wherein said tubular sidewall is a bottle-like shape having a bottle neck portion including the second end and a body portion including the first end, said body portion being a rectangular shape in cross-section having four apex portions and diagonal lines connecting opposing two apex portions, and wherein said window has corresponding four apex portions that are extended inwardly along the diagonal lines.

20. A light detecting device according to claim 19, wherein said electrode assembly comprises a plurality of electrodes each having a cylindrical shape and disposed in spaced apart relation in the longitudinal direction of the tubular sidewall and also in coaxial relation with respect to the center axis.

21. A light detecting device according to claim 20, wherein said electron lens acts to converge the electrons.

* * * * *